United States Patent [19]

Ganster et al.

[11] 3,953,321

[45] Apr. 27, 1976

[54] METHOD OF HYDRODESULFURIZING HEAVY PETROLEUM FRACTION IN THE INITIAL STAGE OF THE ON-STREAM PERIOD

[75] Inventors: Charles A. Ganster; Mary E. Callaghan, both of Port Arthur; Lee K. Gilmer; Gerald V. Nelson, both of Nederland; Kenneth D. Miller, Port Neches, all of Tex.

[73] Assignee: Texaco Inc., New York, N.Y.

[22] Filed: Dec. 27, 1974

[21] Appl. No.: 537,033

[52] U.S. Cl. ..... 208/216
[51] Int. Cl.[2] ..... C10G 23/02
[58] Field of Search ..... 208/216, 209, 213

[56] References Cited

UNITED STATES PATENTS

| | | | |
|---|---|---|---|
| 3,122,495 | 2/1964 | Rosenblatt et al. | 208/216 |
| 3,423,307 | 1/1969 | McKinney et al. | 208/216 |
| 3,491,017 | 1/1970 | Rapp | 208/216 |
| 3,491,018 | 1/1970 | Schuman | 208/216 |
| 3,642,613 | 2/1972 | Nagl | 208/216 |

*Primary Examiner*—Delbert E. Gantz
*Assistant Examiner*—G. J. Crasanakis
*Attorney, Agent, or Firm*—T. H. Whaley; C. G. Ries; Robert Knox, Jr.

[57] ABSTRACT

A desulfurization catalyst is activated by being heated to a temperature between about 750° and 850°F. in the presence of the charge stock to be desulfurized during the initial stages of the on-stream period. In a preferred embodiment the catalyst, prior to the heat treatment, is sulfided at a low temperature and low pressure. The resulting catalyst effectively desulfurizes a petroleum hydrocarbon charge stock with reduced hydrogen consumption.

13 Claims, No Drawings

METHOD OF HYDRODESULFURIZING HEAVY PETROLEUM FRACTION IN THE INITIAL STAGE OF THE ON-STREAM PERIOD

This invention relates to the desulfurization of petroleum fractions. More particularly, it is concerned with the catalytic hydrodesulfurization of heavy petroleum oils under conditions whereby there is a reduction in hydrogen consumption without any substantial diminution in the amount of desulfurization.

The catalytic desulfurization of petroleum hydrocarbons has been well known in the industry for many years, having been discussed quite thoroughly in "Petroleum Processing" November 1956, pages 116–138. The literature discloses reaction conditions using fixed beds of catalysts in the broad ranges of temperatures of from 400°–900°F., pressures of from 50–5000 psig, hydrogen rates of from 200–20,000 standard cubic feet per barrel (scfb) and space velocities of 0.1–20 volumes of oil per volume of catalyst per hour (v/v/hr.)

Experience has shown that in the commercial desulfurization of heavy oils such as vacuum gas oils and heavier stocks, that is, oils having an initial boiling point of about 525°F. or higher, using fixed beds and conventional desulfurization catalysts, the start-of-run temperature using fresh or freshly regenerated catalyst is usually between about 625° and 650°F. and the end-of-run temperature about 800°F., a gradual increase in temperature being made to compensate for loss of activity of the catalyst during the on-stream period. Pressures in the commercial units range generally between about 500 and 1000 psig with hydrogen rates of about 500–2000 scfb. Ordinarily in conventional commercial units the space velocity is controlled to obtain the desired amount of desulfurization with 85–90% desulfurization being considered as the most practical from an efficiency standpoint.

It has been generally accepted in the industry that high temperatures result in shortened catalyst life due to loss of activity on the part of the catalyst through deposition of carbon and, in the case of residue-containing charge stocks, metal-containing compounds on the surface of the catalyst particles. It has also been generally accepted that hydrogen consumption is a function of the amount of desulfurization.

For ecological reasons, it has become necessary for refineries to treat more and more petroleum fractions to reduce the sulfur content thereof thus making desulfurization costs enormous, not only in the amount of equipment that must be built but also in the costs of processing the various petroleum fractions, not the least of which is the cost of hydrogen consumed. It has been ascertained that in today's economy, process improvements leading to a reduction in hydrogen consumption of 50 scfb in a 20,000 barrel per day unit which, according to today's standards is of modest size, would result in an annual saving of approximately $200,000.

It is therefore an object of the present invention to reduce hydrogen consumption in the catalytic desulfurization of heavy petroleum oils. Another object is to provide a novel process for the presulfiding of a desulfurization catalyst. Still another object is to pretreat a desulfurization catalyst to enhance its desulfurization activity. These and other objects will be obvious to those skilled in the art from the following disclosure.

Our invention provides a process for the catalytic desulfurization of a heavy petroleum fraction having an initial boiling point of at least about 500°–650°F. which comprises initiating an on-stream period by contacting a desulfurization catalyst comprising a Group VI metal or compound thereof and an iron group metal or compound thereof supported on an inert refractory inorganic oxide with said heavy petroleum fraction at a temperature between about 750° and 850°F. for a period of at least about 12 hours, then reducing the temperature of the reaction zone to between about 600° and 650°F. to institute the desulfurization on-stream period. In a preferred embodiment the catalyst is presulfided by contact with a lighter petroleum fraction having an end boiling point not greater than about 625°–650°F. containing an added sulfur compound at a temperature between about 200° and 500°F. and a pressure between about 100 and 300 psig thereby converting said catalyst to the sulfide form.

The feed used in the process of our invention is a heavy petroleum oil fraction having an initial boiling point of at least about 500°–650°F. Examples of such feeds are gas oils such as vacuum gas oils, atmospheric residua, coker distillates, coal tar distillates and gas oils obtained from shale, tar sand and the like. Generally they contain from about 0.5 to 5.0 wt. % sulfur.

The hydrogen used in the process of our invention may be obtained from any suitable source. Catalytic reformer by-product hydrogen, hydrogen produced by the partial oxidation of carbonaceous or hydrocarbonaceous materials followed by shift conversion and $CO_2$ removal or electrolytic hydrogen are satisfactory. The hydrogen should have a purity of at least 50% and preferably at least 65% by volume, the higher the purity, the greater the partial pressure of the hydrogen.

The catalyst used in the process of our invention generally comprises a Group VIII metal such as an iron group metal or compound thereof optionally composited with a Group VI metal or compound thereof on a refractory inorganic oxide support. Suitable Group VIII metals are particularly nickel and cobalt used in conjunction with tungsten or molybdenum. Advantageously the iron group metal is present in an amount between about 1.0 and 10% by weight of the catalyst composite and the Group VI metal is present in an amount between about 5 and 30% also based by weight on the catalyst composite. Examples of refractory inorganic oxides which may be used as a support are silica, alumina, magnesia, zirconia and the like or mixtures thereof. In a preferred embodiment the support is composed for the most part of alumina with a minor amount, e.g. up to about 15 wt. % silica.

The catalyst may be prepared by forming the support which, in a preferred embodiment, is alumina containing a small amount, e.g. about 3 wt. % silica. The support may then be impregnated with the desired metals by use of a solution of a water-soluble compound of the metal. For example, water solutions of ammonium molybdate, cobalt nitrate, nickel nitrate and ammonium metatungstate may be used for impregnation. After the impregnation of the metallic materials on the support, the catalyst composite is ordinarily dried and then calcined for several hours in air at high temperature, e.g. 900°–1000°F. In this way, the catalytic metals are usually present as the oxide.

The catalyst may be used as a moving bed, a fixed bed or a fluidized bed. In a preferred embodiment, the catalyst is used as a fixed bed of particles which may be spheroids or cylindroids, the latter being preferred. When the catalyst is used as a fixed bed, the oil flow may be either upward or downward with concurrent hydrogen flow or the flow of oil may be downward counter to upwardly flowing hydrogen. In a preferred embodiment the hydrogen and the oil both pass downwardly through a fixed bed of catalyst particles.

In commercial installations it is customary to separate the hydrogen from the desulfurization zone effluent and recycle the separated hydrogen to the desulfurization zone. To prevent the buildup of impurities such as low molecular weight gaseous hydrocarbons, hydrogen sulfide and ammonia, a portion of the recycled hydrogen may be bled from the system and replaced with fresh hydrogen. Hydrogen may also be added to the recycle stream to replace that consumed in the desulfurization process. The ammonia and hydrogen sulfide may also be removed by contacting the recycle hydrogen with a methanol-amine-water solution.

After startup, the reaction conditions in the desulfurization zone may be varied depending on the amount of desulfurization desired and on the charge stock. Temperatures broadly may range from about 450° to 850°F., hydrogen partial pressures from 300 to 3000 psig, hydrogen rates from about 500 to 20,000 scfb (standard cubic feet per barrel) and space velocities from 0.1 to 10 v/v/hr. (volumes of feed per volume of catalyst per hour). Preferred reaction conditions are temperatures of about 625° to 775°F., hydrogen partial pressures of 500 to 1500 psig, hydrogen rates from 1000 to 5000 scfb and space velocities of from 0.5 to 5. Most commercial units are designed to operate at a space velocity of 1.

Ordinarily the desulfurization on-stream period is conducted at an initial temperature of about 625°F. and the temperature is gradually increased until the catalyst becomes deactivated due to the deposition of carbon thereon. Usually, the on-stream period is terminated when the catalyst temperature reaches about 800°F. at which point the catalyst is regenerated by burning the carbon deposits in a manner well known in the art. It has now been found that a greater saving in hydrogen consumption can be obtained if at the outset of the on-stream period the reactor temperature is raised to between about 750° and 850°F. and held at that temperature for a period of between about 12 and 100 hours after which the temperature is reduced to about 625°F. and the operating conditions are set to obtain about 90% desulfurization. By subjecting the catalyst to this preliminary heat treatment a saving of from about 30–40 scfb is obtained. However, after this preliminary treatment it has also been found that to obtain 90% desulfurization a temperature about 5° F. higher is required than would be the case if the startup had been conventional and there had been no high temperature treatment. However, it has also been found that if a specific sulfiding treatment is used this loss in activity is minimized.

The specific sulfiding treatment may be performed on either new or freshly regenerated catalyst which in each case is in oxide form. Preferably it is effected in situ and comprises contacting the catalyst with a hydrocarbon oil having an end boiling point not greater than about 625°–650°F. such as kerosene or a diesel fraction containing added sulfur at a relatively low temperature of about 200°–500°F. and a relatively low pressure of about 100–300 psig for several hours until the catalyst has become sulfided. Preferably prior to the sulfiding treatment the reactor is purged with nitrogen and the nitrogen flow is continued while the lighter oil containing added sulfur is introduced into contact with the catalyst. In a particularly preferred embodiment, after the catalyst has become sulfided, the flow of lighter oil without added sulfur compound is continued and the reaction conditions are brought to the desired conventional desulfurization conditions. This includes raising the temperature and pressure and switching from nitrogen to hydrogen. At this point the flow of the lighter oil may be discontinued and the charge may be cut in with the temperature being raised to between about 750° and 850°F. and held there for from about 12 to 100 hours. Optionally the heat pretreatment may be effected in the presence of the lighter oil free from added sulfur with the switch to the heavier oil feed taking place after the heat treatment after which the temperature is reduced and conventional operation to obtain the desired amount of desulfurization is instituted.

For the sulfiding of the calalyst an organic sulfur-containing compound is used. Examples of such compounds are sulfides, disulfides and mercaptans with carbon disulfide and low molecular weight mercaptans such as those containing 1–4 carbon atoms being preferred. Sufficient sulfur compound should be added to the lighter oil to adjust its sulfur content to between about 0.5 and 2.0 wt. %.

The oil containing added sulfur may be passed through the catalyst zone at a space velocity between about 2 and 8 preferably between 3 and 6 v/v/hr.

The following examples are submitted for illustrative purposes only and it should not be construed that the invention is restricted thereto.

EXAMPLE I

The charge in this example is a gas oil having the following characteristics:

TABLE 1

| | |
|---|---|
| Gravity (°API) | 24.7 |
| Sulfur (wt. percent) | 1.29 |
| Nitrogen, (ppm) | 1128 |
| Watson Aromatics (wt. percent) | 48.5 |
| UV Absorbance at 285 mu | 8.59 |
| Distillation, ASTM, °F. | |
| IBP | 520 |
| 10% | 593 |
| 50% | 778 |
| 90% | 921 |
| EP | 1050 |

In Run A, the catalyst is in the form of a fixed bed of 1/16 inch extrudates and contains 2.9 wt. % cobalt oxide, 14.6 wt. % molybdenum oxide, 3.4 wt. % silica and the balance alumina. It has a surface area of 282 $m^2/g$ and a pore volume of 0.58 cc/g. In Run B the same catalyst is used but it is first contacted with the oil charge for 96 hours at 790°F. in the presence of hydrogen.

Reaction conditions to obtain 90% desulfurization and other data appear below:

TABLE 2

| | Case A | Case B |
|---|---|---|
| Reactor Temperature, °F. | 670 | 677 |
| Hydrogen Partial Pressure, psia | 920 | 920 |
| Space Velocity, Vo/Hr/Vc | 0.93 | 0.93 |
| Reactor Feed Gas Rate, scfb | 2350 | 2350 |
| Feed Gas Purity, Vol % $H_2$ | 85 | 85 |
| Percent Desulfurization | 90 | 90 |
| Hydrogen Consumption, scfb | 360 | 330 |

TABLE 2-continued

| | Case A | Case B |
|---|---|---|
| Product Quality | | |
| Gravity (°API) | 28.2 | 28.4 |
| Sulfur (wt. percent) | 0.13 | 0.13 |
| Nitrogen (ppm) | 677 | 797 |
| Watson Aromatics (wt. percent) | 44.4 | 44.6 |
| UV Absorbance at 285 mu | 4.00 | 4.23 |

The comparative data show that desulfurization under conventional conditions to a 90% desulfurization entails a hydrogen consumption of 360 scfb whereas by subjecting the catalyst to a prior heat treatment the same amount of desulfurization is obtained with a hydrogen consumption of 330 scfb.

EXAMPLE II

The charge in this example is a vacuum gas oil having the following characteristics:

TABLE 3

| | |
|---|---|
| Gravity (°API) | 21.3 |
| Sulfur (wt. percent) | 2.23 |
| Nitrogen (ppm) | 1128 |
| Watson Aromatics (wt. percent) | 53.5 |
| UV Absorbance at 285 mu | 9.87 |
| Distillation, ASTM, °F. | |
| IBP | 650 |
| 10% | 784 |
| 50% | 843 |
| 90% | 929 |
| EP | 1050 |

Run A is similar to Run A of Example I in that the same catalyst is used in a conventional manner under conditions to obtain 90% desulfurization. In Run B the catalyst is sulfided prior to the institution of the desulfurization by being contacted with a 550°–650°F. boiling range fraction, to which 1.85 lb. carbon disulfide had been added per barrel of oil, at a temperature of 400°F. and a pressure of 200 psig in the presence of nitrogen. After sulfiding, the start-up of the desulfurization step is the same as Run A in Example II. Run C is similar to Run B except that after the sulfiding treatment the charge oil is introduced into the reactor with hydrogen at the rates tabulated below and the temperature in the reactor is increased to 790°F. and held there for 48 hours. The reaction conditions for 90% desulfurization are then maintained. Operating conditions and other data appear below.

TABLE 4

| Operating Conditions | Run A | Run B | Run C |
|---|---|---|---|
| Reactor Temperature, °F. | 690 | 682 | 695 |
| Hydrogen Partial Pressure, psia | 750 | 750 | 750 |
| Space Velocity, Vo/Hr/Vc | 1.0 | 1.0 | 1.0 |
| Reactor Feed Gas Rate, scfb | 2000 | 2000 | 2000 |
| Feed Gas Purity, Vol % $H_2$ | 96–98 | 96–98 | 96–98 |
| Percent Desulfurization | 90 | 90 | 90 |
| Hydrogen Consumption, scfb | 508 | 498 | 481 |
| Product Quality | | | |
| Gravity (°API) | 26.7 | 26.2 | 26.7 |
| Sulfur (wt. percent) | 0.22 | 0.22 | 0.22 |
| Nitrogen (ppm) | 705 | 697 | 812 |

TABLE 4-continued

| Operating Conditions | Run A | Run B | Run C |
|---|---|---|---|
| Watson Aromatics (wt. percent) | 44.2 | 44.2 | 44.7 |
| UV Absorbance at 285 mu | 4.76 | 5.13 | 5.49 |

These data show the superiority of the catalyst after it has been subjected to both the sulfiding and the heat treatment.

Various modifications of the invention as hereinbefore set forth may be made without departing from the spirit and scope thereof, and therefore, only such limitations should be made as are indicated in the appended claims.

We claim:

1. A process for the catalytic hydrodesulfurization of a heavy petroleum fraction having an initial boiling point of at least about 500°–650°F. which comprises contacting a hydrodesulfurization catalyst comprising a Group VI metal or compound thereof and an iron group metal or compound thereof supported on an inert refractory inorganic oxide selected from the group consisting of silica, alumina, magnesia, zirconia and mixtures thereof with hydrogen and with said heavy petroleum fraction at a temperature between about 750° and 850°F. for a period of at least about 12 hours, then reducing the tempeature of the reaction zone to between about 600° and 750°F. to institute the desulfurization on-stream period.

2. The process of claim 1 in which the heavy petroleum fraction is a vacuum gas oil.

3. The process of claim 1 in which the heavy petroleum fraction is a petroleum residuum.

4. The process of claim 1 in which the catalyst prior to said contacting is sulfided by a process which comprises contacting the catalyst with a lighter petroleum fraction having an end boiling point not greater than about 625°–650°F. containing an added sulfur compound at a temperature between about 200° and 500°F. and a pressure between about 100 and 300 psig.

5. The process of claim 4 in which the added sulfur compound is carbon disulfide.

6. The process of claim 4 in which the added sulfur compound is a $C_1$–$C_4$ mercaptan.

7. The process of claim 4 in which the sulfiding is carried out in the presence of hydrogen.

8. The process of claim 4 in which the sulfur content of the lighter petroleum fraction is between 0.5 and 1.5 wt. %.

9. The process of claim 1 in which the Group VI metal is selected from the group consisting of tungsten and molybdenum.

10. The process of claim 1 in which the iron group metal is selected from the group consisting of nickel and cobalt.

11. The process of claim 4 in which the lighter fraction is introduced into the reaction zone at a rate to provide a space velocity between 2 to 8 v/v/hr.

12. The process of claim 4 in which the sulfiding is carried out in an inert atmosphere.

13. The process of claim 11 in which the inert atmosphere is nitrogen.

* * * * *